US007042402B2

(12) United States Patent
Modro

(10) Patent No.: US 7,042,402 B2
(45) Date of Patent: May 9, 2006

(54) PLANAR ANTENNA

(75) Inventor: Joseph C. Modro, Dublin (IE)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 11/117,494

(22) Filed: Apr. 29, 2005

(65) Prior Publication Data

US 2005/0248488 A1 Nov. 10, 2005

(30) Foreign Application Priority Data

May 5, 2004 (EP) ..... 04010663

(51) Int. Cl.
*H01Q 1/38* (2006.01)

(52) U.S. Cl. ..... 343/700 MS; 343/767

(58) Field of Classification Search ..... 343/700 MS, 343/767, 768, 846, 848, 769, 873; H01Q 1/38, H01Q 13/10
See application file for complete search history.

(56) References Cited

U.S. PATENT DOCUMENTS

| | | | | |
|---|---|---|---|---|
| 3,623,162 | A | 11/1971 | Whitty | |
| 4,975,711 | A | 12/1990 | Lee | |
| 5,754,143 | A | 5/1998 | Warnagiris et al. | |
| 5,781,158 | A | 7/1998 | Ko et al. | |
| 5,940,041 | A | 8/1999 | Koyama et al. | |
| 5,943,020 | A | 8/1999 | Liebendoerfer et al. | |
| 5,986,606 | A * | 11/1999 | Kossiavas et al. | 343/700 MS |
| 6,124,831 | A | 9/2000 | Rutkowski et al. | |
| 6,133,883 | A * | 10/2000 | Munson et al. | 343/700 MS |
| 6,198,437 | B1 | 3/2001 | Watson et al. | |
| 6,222,497 | B1 * | 4/2001 | Hu et al. | 343/846 |

(Continued)

FOREIGN PATENT DOCUMENTS

| | | |
|---|---|---|
| DE | 861 114 C | 12/1952 |
| EP | 0 669 672 | 8/1995 |
| EP | 0 829 917 A | 3/1998 |
| EP | 0 997 973 A | 5/2000 |
| EP | 1 176 664 A | 1/2002 |
| GB | 2 276 274 A | 9/1994 |
| JP | A-2000-059125 | 2/2000 |

OTHER PUBLICATIONS

Ik Guen Choi et al.; "UHF Tapered Bent-Slot Antenna For Small Size Portable Phone"; from Pioneers to the 21st Century; *IEEE*; vol. 2; Conf 42; May 10, 1992; pp. 9-12.

(Continued)

*Primary Examiner*—Hoanganh Le
(74) *Attorney, Agent, or Firm*—Oliff & Berridge, PLC

(57) ABSTRACT

An antenna comprising a lamina of conductive material, the antenna being operable in one or more resonant operational modes in which at least one portion of the antenna is associated with an relatively high electromagnetic field and in which at least one other portion of the antenna is associated with a relatively low or substantially no electromagnetic field. The lamina is folded on itself so that said at least one portion of the antenna lies on an obverse face of the antenna and said at least one other portion of the antenna lies on the reverse face of the antenna. In one embodiment, the antenna is a slot-loop antenna. In a second embodiment, the antenna acts as a quarter wave monopole.

20 Claims, 6 Drawing Sheets

U.S. PATENT DOCUMENTS

| | | | | |
|---|---|---|---|---|
| 6,281,854 | B1 | 8/2001 | Ohoka et al. | |
| 6,343,208 | B1 | 1/2002 | Ying | |
| 6,407,715 | B1 | 6/2002 | Chen | |
| 6,417,809 | B1 * | 7/2002 | Kadambi et al. | 343/702 |
| 6,445,358 | B1 * | 9/2002 | Takahashi et al. | 343/828 |
| 6,452,554 | B1 | 9/2002 | Aoyama et al. | |
| 6,518,924 | B1 | 2/2003 | Desclos et al. | |
| 6,750,821 | B1 * | 6/2004 | Fang et al. | 343/700 MS |
| 2001/0052877 | A1 | 12/2001 | Royden et al. | |

OTHER PUBLICATIONS

Santiago Sierra-Garcia et al.; "Study of a CPW Inductively Coupled Slot Antenna"; *IEEE Transactions on Antennas and Propagation*; vol. 42, No. 1; Jan. 1, 1999; pp. 58-64.

Wen-Shan Chan et al.; "A Coplanar Waveguide-Fed Printed Slot Antenna for Dual-Frequency Operation"; *IEEE*; vol. 1; Jul. 8, 2001; pp. 140-143.

* cited by examiner 110
115
116
117
118
120
121
122
124
126
132
134
136
a
$W_b$
$W_s$
KEY:
Magnetic current
Electric field
Electric Field strength ≈ 0

215

210
212,216
225
215

B
C
C
221

223
220
217
225

215
A

Electric field
Electric current
Electric Field strength ≈ 0
KEY:

210
215
216
217
220
225
232
234
236
A
B
C
0

KEY:
Electric field
Electric current
Electric Field strength ≈ 0

PLANAR ANTENNA

FIELD OF THE INVENTION

The invention relates to antennas, especially, but not exclusively, electrically small planar antennas for use in portable wireless devices such as mobile (cellular) telephones, personal digital assistants (PDAs) and audio-visual entertainment devices.

BACKGROUND OF THE INVENTION

There is a general trend towards miniaturisation of portable electronic devices, including portable wireless devices. As a result, antennas compete for space with the other device components (e.g. battery, display, keypad, printed circuit board).

In addition, modern wireless systems demand increasingly greater bandwidths in order to accommodate higher data rates. This is particularly true of video and audio applications that use the Ultra-Wideband (UWB) protocols being standardised by the IEEE. However, the goals of reduced physical size and increased bandwidth are not normally compatible. Further, reducing the physical size of the antenna normally tends to reduce the radiation efficiency of the antenna.

It would be desirable, therefore, to provide an antenna which, physically, is relatively small while satisfying relatively large bandwidth requirements and radiation efficiency requirements.

SUMMARY OF THE INVENTION

Accordingly, the invention provides an antenna comprising a lamina of conductive material, the antenna being operable in one or more resonant operational modes in which at least one portion of the antenna is associated with an relatively high electromagnetic field and in which at least one other portion of the antenna is associated with a relatively low or substantially zero electromagnetic field, wherein the lamina is folded on itself so that said at least one portion of the antenna lies in a first plane and said at least one other portion of the antenna lies in a second plane, the second plane being substantially parallel with the first plane.

Hence, the antenna is folded on itself so that the portions of the antenna or lamina that are associated with a non-negligible electric field (and in some embodiments a non-negligible magnetic current) are located on an obverse face of the antenna, while the portions of the antenna or lamina that are associated with a negligible, or zero, electric field (and in some embodiments a negligible, or zero, magnetic current) are located on the reverse face of the antenna. By folding the antenna in this way, the overall thickness of the antenna is not appreciably increased. Moreover, since the folded slot portions are not associated with a significant electric field, they may be folded into a position in which they are in close proximity with one another without causing electromagnetic interference with one another.

In preferred embodiments, the lamina is provided on a substrate layer, for example a layer of dielectric material, the lamina being folded around said substrate layer so that said at least one portion of the antenna is located on an obverse face of the substrate layer and said at least one other portion of the antenna is located on a reverse face of the substrate layer.

In one embodiment, the antenna is operable in a resonant mode in which the lamina acts as a quarter wave monopole.

In an alternative embodiment, the antenna is a slot-loop type antenna and comprises a layer of conductive material which provides said lamina and which is shaped to define a slot loop around said lamina, the antenna being operable in one or more resonant operational modes in which at least one portion of said slot loop is associated with a relatively high electromagnetic field and in which at least one other portion of said slot loop is associated with a relatively low or substantially no electromagnetic field, wherein the conductive layer is folded on itself so that said at least one portion of said slot loop lies in said first plane and said at least one other portion of said slot loop lies in said second plane.

In such an embodiment, the antenna may be operable in a full wavelength, or fundamental, resonant operational mode in which the electrical length of said loop slot is substantially equal to the wavelength of signals at the operational frequency of the antenna.

Preferred features of the invention are recited in the dependent claims and further advantageous aspects of the invention will become apparent to those ordinarily skilled in the art upon review of the following description of a specific embodiment of the invention and with reference to the accompanying drawings.

BRIEF DESCRIPTION OF THE DRAWINGS

An embodiment of the invention is now described by way of example and with reference to the accompanying drawings in which similar numerals are used to indicate similar parts and in which:

FIG. 5*a* is a plan view of the obverse face of a folded rectangular lamina antenna embodying the present invention;

FIG. 5*b* is a plan view of the reverse face of the antenna of FIG. 5*a;*

FIGS. 5*c* to 5*f* each present a respective side view of the antenna of FIG. 5*a.

DETAILED DESCRIPTION OF THE DRAWINGS

Figure 1:
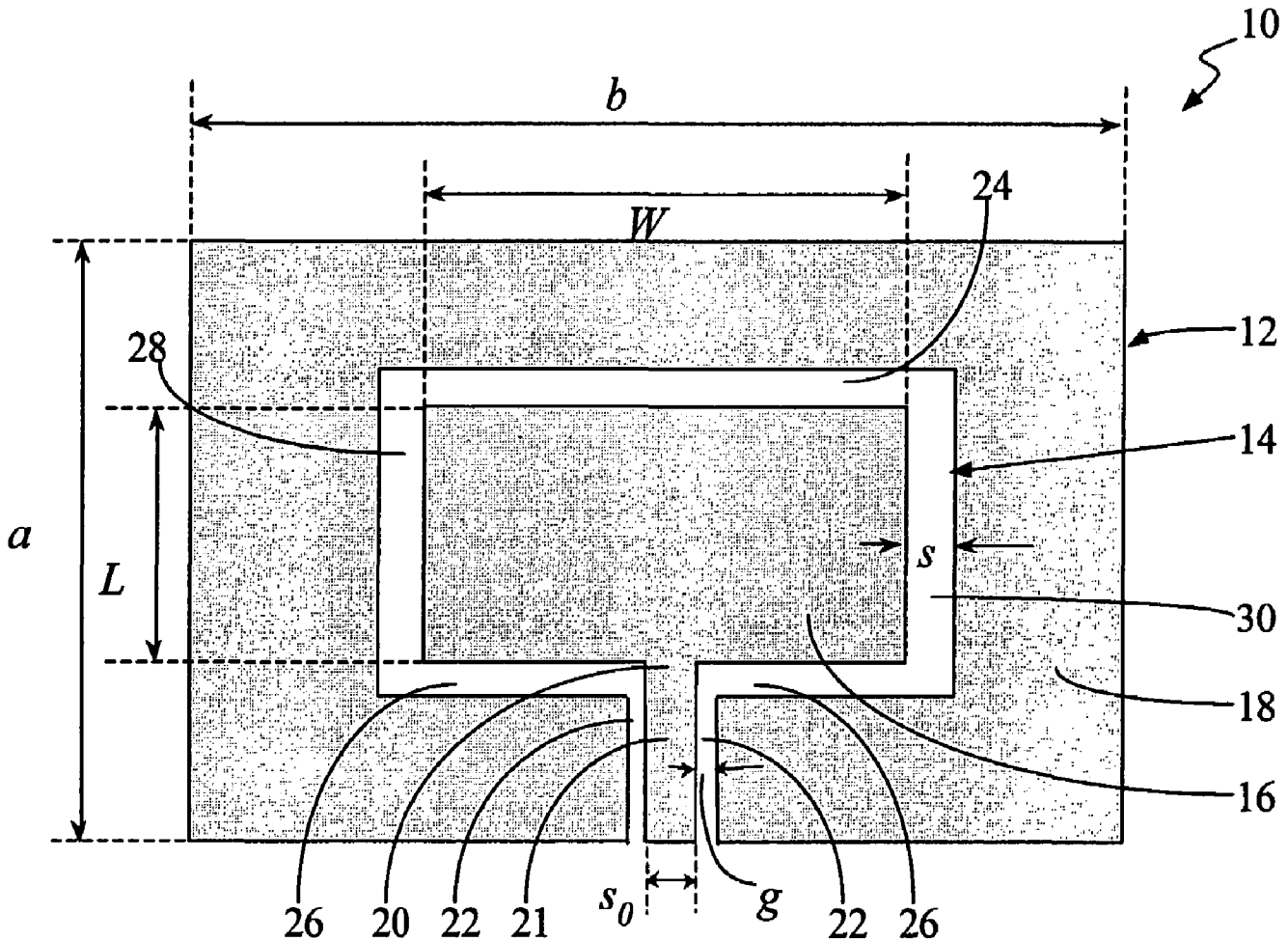
FIG. 1 is a plan view of a rectangular slot-loop planar antenna.

Referring now to FIG. 1 of the drawings, there is shown, generally indicated as 10, a planar antenna comprising a layer 12 of electrically conductive material, typically metal, e.g. copper, usually provided on a substrate layer (not shown), for example of dielectric material, or any other suitable material. Typically, the antenna 10 is generally rectangular in shape having a length denoted as a and a width denoted as b.

A quantity of the conductive material is removed from layer 12 to define a generally rectangular loop-shaped slot 14 (which may be referred to as a slot-loop) through which the substrate is exposed. The slot 14 divides the conductive layer 12 into a lamina 16 and a ground plane member 18. The slot 14 substantially surrounds the lamina 16 but is open ended to provide a feed point or portion 20 of conductive material by which electrical signals (typically electromagnetic signals such as radio frequency (RF) or microwave signals) may be fed to and received from the lamina 16. A coupling device in the form of a conductive feed line 21, for example a coplanar waveguide, is provided for supplying signals to, and/or receiving signals from, the lamina 16 via the feed portion 20. The feed line 21 is electrically isolated from the ground plane 18 by feed line slot portions 22. Where a coplanar waveguide is used, the coplanar waveguide excitation ground connections are preferably directly adjacent the end of feed line 21.

The slot 14 is generally loop shaped and comprises a first slot portion 24 which is oppositely disposed with respect to the feed portion 20; a second slot portion 26 which is oppositely disposed with respect to the first slot portion 14 and is interrupted by the feed portion 20; and third and fourth slot portions 28, 30 which are oppositely disposed with respect to one another and which join the first and second slot portions 24, 26 at respective ends. In the preferred embodiment, the slot 14 is generally rectangular, the first and second slot portions 24, 26 being generally parallel with one another and the third and fourth slot portions 28, 30 being generally parallel with one another. Hence, the lamina 16 is also generally rectangular in the preferred embodiment.

The antenna 10 may be said to be planar in that the lamina 16, ground plane 18, slot 14 and feed portion 20 all lie in a common primary plane. The lamina 16, ground plane 18 and slot 14 may together be referred to as the resonant structure of the antenna 10. Depending on the physical and electrical characteristics of the resonant structure, one or more elements of the resonant structure may serve as the seat for standing electromagnetic waves during one or more resonant modes of use (for example, when excited by an electromagnetic signal in an operational frequency band supplied via feed line 21 or received from free space).

The antenna 10 may be referred to as a slot-loop, or loop slot, antenna and, when operating as such, the slot 14 provides a resonant path for standing electromagnetic waves. The electromagnetic waves are present in the slot 14 when the slot 14 operates in one or more resonant modes of operation. The characteristics of the standing electromagnetic waves depend on the resonant mode. In one or more resonant modes, the characteristics of the electromagnetic waves are such that, in some portions of the slot 14 the strength of the near-field magnetic field and associated electric field is maximized while in other portions of the slot 14 the strength of the magnetic field and associated electric field is negligible or substantially zero.

Figures 2A, 2B, 2C, 2D, 2E, 2F:
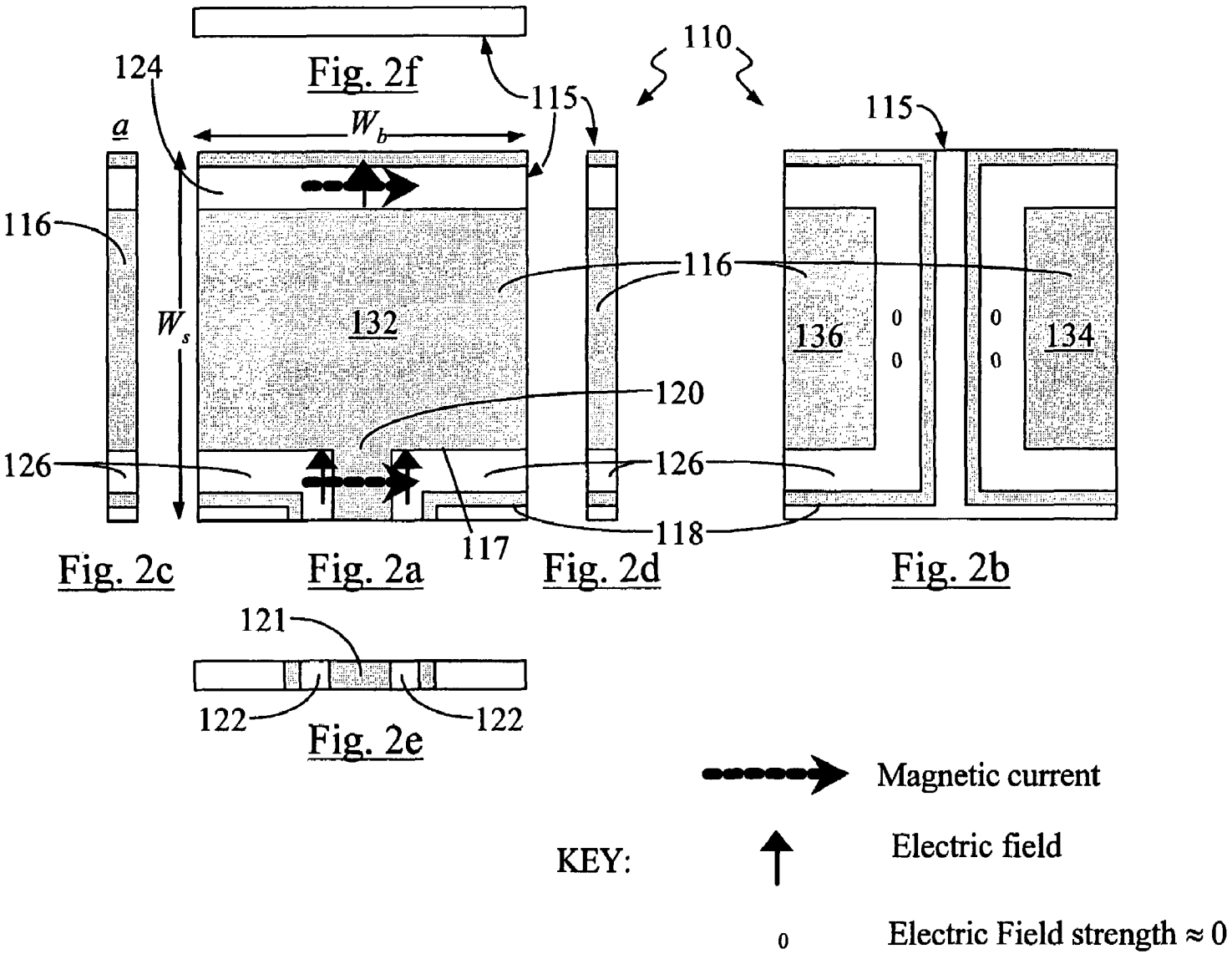
FIG. 2*a* is a plan view of the obverse face of a rectangular slot-loop planar antenna embodying the present invention.
FIG. 2*b* is a plan view of the reverse face of the antenna of FIG. 2*a;*
FIGS. 2*c* to 2*f* each present a respective side view of the antenna of FIG. 2*a;*

In particular, the antenna 10 is operable in a slot-loop fundamental, or full wavelength, resonant mode in which the electrical length of the slot 14 is substantially equal to one full wavelength of signals at the operating frequency (typically the centre frequency of an operating band) of the antenna 10. When the antenna 10 operates in the fundamental resonance mode, it is observed that the strength of the near-field electric and magnetic fields are maximized in the first and second slot portions 24, 26, and more particularly substantially at or around the respective midpoints of the first and second slot portions. This is illustrated in FIG. 2 by broken arrows, which indicate the areas of maximum magnetic current, and solid arrows which indicate the areas of maximum electric field. In this mode of operation, the magnetic current vectors in slot portions 24, 26 are in phase and constructively contribute to far-field radiation, as do the associated electric fields. However, the strength of the electric and magnetic fields in the third and fourth slot portions 28, 30 is very small or substantially zero. In general, the electromagnetic field characteristics described above are best exhibited where the length W of the first slot portion 24 is greater than the length L of the third and fourth slot portions 28, 30. In preferred embodiments, the aspect ratio of the slot 14, i.e. the ratio of W/L is greater than 1 but less than or equal to 2.

Accordingly, it is proposed that the or each portion of the antenna 10 which includes one or more slot portion which, during one or more resonant mode, is associated with, or adjacent, negligible or substantially zero electric field (or magnetic current) may be folded to lie in a plane which is non-coplanar with the primary antenna plane, while the antenna portion(s) which include one or more slot portion which, during the same resonant mode, is associated with, or adjacent, a non-negligible magnetic current or electric field lie in the primary antenna plane. By folding the antenna 10 in this way, the size of the antenna 10 in at least one direction (in the present example the overall antenna width b) is reduced and, accordingly, so too is the area of the antenna 10. Moreover, since the folded slot portions are not associated with, or adjacent, an appreciable electric field (or magnetic current or field), they do not give rise to destructive electromagnetic interference. Accordingly, it is found that the performance of the antenna 10 in terms of bandwidth and radiation efficiency is not adversely affected.

In the preferred embodiment described hereinafter, the folded antenna portions are folded to lie in a plane that is substantially parallel with the primary antenna plane. Hence, the antenna 10 is folded on itself so that the portions of the antenna 10 that are associated with a non-negligible or relatively high electric field or magnetic current are located on an obverse face of the antenna 10, while the portions of the antenna 10 that are associated with a relatively low, negligible, or zero, electric field or magnetic current are located on the reverse face of the antenna 10. By folding the antenna 10 in this way, the overall thickness of the antenna (in a direction perpendicular to both the length a and width b) is not appreciably increased. Moreover, since the folded slot portions are not associated with an appreciable electric field, they may be folded into a position in which they are in close proximity with one another without causing electromagnetic interference with one another.

Figure 3:
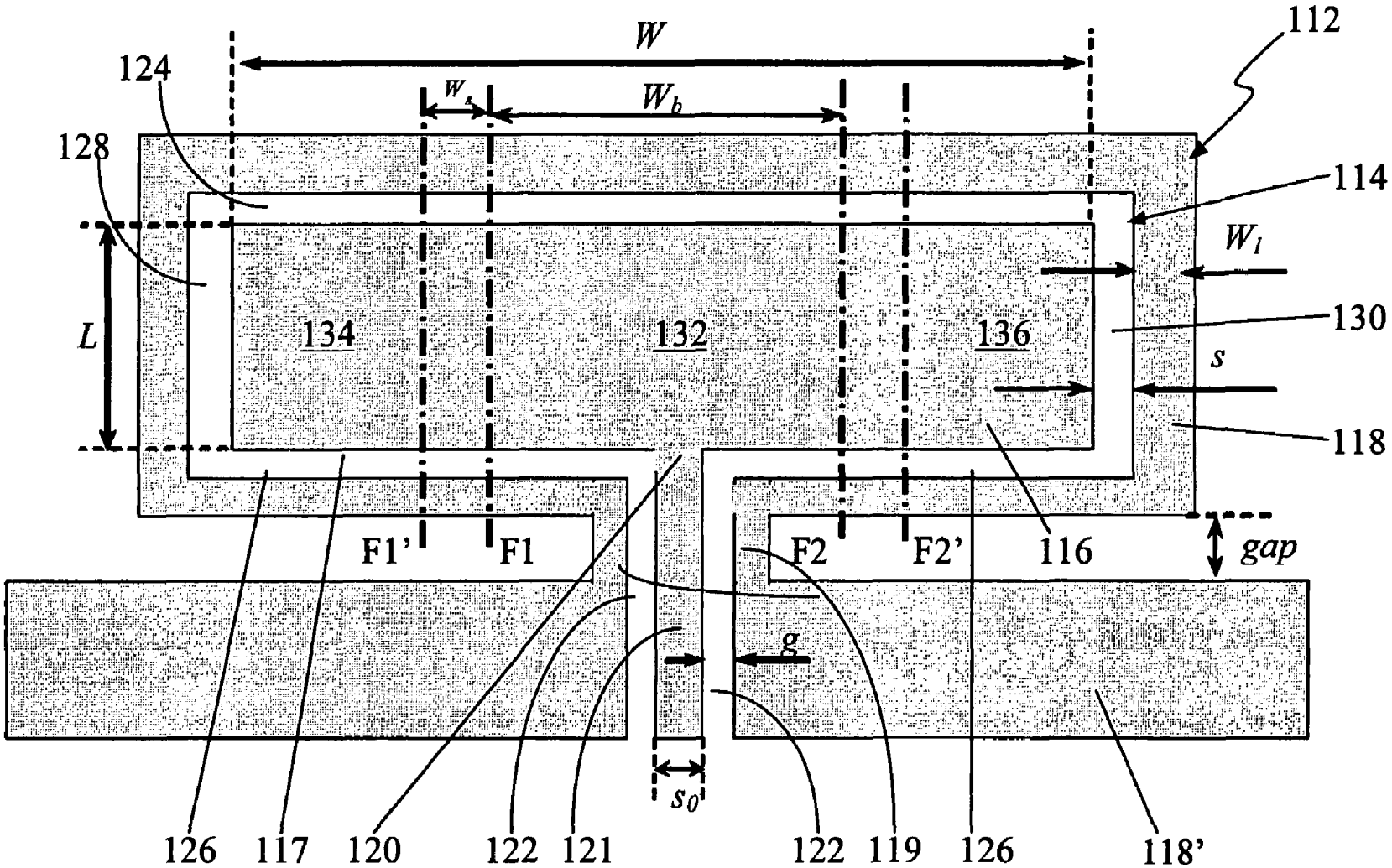
FIG. 3 is a plan view of the antenna of FIGS. 2*a* to 2*f* shown in an unfolded state for illustrative purposes and includes a feed line.

Referring now to FIG. 3, there is shown a layout of an unfolded conductive layer 112, including a generally rectangular loop slot 114, ground plane 118, and radiator lamina 116, which is generally similar to the conductive layer 12 of antenna 10 and, accordingly, like numerals are used to indicate like parts (although the values of dimensions L, W, a and b need not necessarily be the same as for antenna 10). In order to reduce the overall dimensions a, b, it is preferred that the ground plane 118 is reduced in size in comparison with the ground plane 18 of antenna 10 such that the ground plane 118 comprises a strip of conductive material which substantially surrounds the slot 114. By way of example, the width W1 of the ground plane 118 may be similar to, or comparable with, the width s of the slot 114. It is preferred that the antenna 110, and more particularly the lamina 116, is fed from a side or edge (as illustrated in FIG. 3) and hence the feed point 120 is located at the side or edge 117 of the lamina 116 defined by the slot portions 126. Preferably, the feed point 120 is located substantially at the mid-point of the edge 117. The lamina 116 is typically generally rectangular in shape, the feed point 120 typically being located on one of the longer edges (when the aspect ratio is other than 1:1). The feed line 121 may comprise a coplanar waveguide or may comprise any other suitable feed mechanism, for example a microstrip line (not illustrated).

It is also preferred that portions of the ground plane are removed to provide a gap between the ground plane 118 for the slot-loop and the ground plane 118' for the feed line 121. The slot-loop ground plane 118 and the feed line ground plane 118' are joined by bridge portions 119 and the gap runs substantially parallel with the second slot portions 126. It will be understood, however, that it is equally possible to fold an antenna of the type illustrated in FIG. 1 without removing any portions from the ground plane.

The conductive layer 112 is suitable for use as a planar slot-loop antenna on its own or when provided on a substrate, for example a layer of dielectric material (not shown) or other suitable material.

A first notional fold line F1 is shown between the feed portion 120 and the third slot portion 128, the fold line F1 running substantially perpendicular to, and intersecting, the first and second slot portions 124, 126 and, in the present embodiment, running substantially parallel with the longitudinal axis of the feed line 121. A second notional fold line F2 is similarly provided between the feed portion 120 and the fourth slot portion 130. The fold lines F1 and F2 are positioned to notionally divide the conductive layer 112 into three regions: a main or central region 132 of width Wb (which includes the feed point 120) defined between the fold lines F1 and F2, the slot portions of which, during fundamental resonance mode, are associated with an appreciable electric field or magnetic current; a first end region 134 defined beyond the fold line F1 with respect to the central region 132, the slot portions of which, during fundamental resonance mode, are associated with substantially zero electric field or magnetic current; and a second end region 136 defined beyond the fold line F2 with respect to the central region 132, the slot portions of which, during fundamental resonance mode, are associated with substantially zero electric field or magnetic current.

Because the end regions 134, 136 carry negligible or substantially zero electric field/magnetic current during the fundamental resonance mode, they may be folded to lie in a plane, or respective planes, that are non-coplanar with the plane in which the central region 132 lies (i.e. the primary plane of the planar antenna) without adversely affecting bandwidth or radiation efficiency. In the preferred embodiment, the conductive layer 112 is folded in on itself so that the end regions 134, 136 lie in a common plane that is substantially parallel with the plane in which the central region 132 lies. To this end, two further notional fold lines F1', F2' are defined, each being substantially parallel with the respective fold lines F1, F2 and located in a respective end region 134, 136. Hence, by folding the conductive layer 112 in on itself by approximately 90° at each of the respective fold lines F1, F1' and F2, F2', the respective end region 134, 136 (or at least the portion of the respective end regions 134, 136 beyond the respective fold lines F1', F2') are folded through approximately 180° with respect to the central region 132. In the preferred embodiment, the spacing Ws between fold line pairs F1, F1' and F2, F2' are equal so that the folded end regions 134, 136 lie in a common plane.

In the foregoing description, the electromagnetic fields generated in the resonant modes are said to be associated with respective portions of the slot 14, 114. It may also be said that the electromagnetic fields are associated with adjacent portions (typically the edges) of the lamina 16, 116 itself, since the edges of the lamina 16, 116 partially define the slot 14, 114.

Referring now to FIGS. 2*a* to 2*f*, there is shown a preferred embodiment of a planar rectangular slot-loop antenna 110 comprising the conductive layer 112 provided on a generally rectangular substrate layer 115 (e.g. of dielectric material) which has a width substantially equal to Wb, a length substantially equal to a, and a thickness of approximately Ws. The antenna 110 has a generally rectangular obverse face (FIG. 2*a*) and a generally rectangular reverse face (FIG. 2*b*) joined by four generally rectangular side faces (FIGS. 2*c* to 2*f*). The obverse face and reverse face are generally parallel and oppositely disposed with respect to one another, the side faces being generally perpendicular to the obverse and reverse faces. The conductive layer 112 is provided on the substrate layer 115 such that the central region 132, including the feed portion 120, is located on the obverse face and that the end regions 134, 136 are located partly on opposing side faces (FIGS. 2*c* and 2*d*) but mainly on the reverse face. Hence, the slot 14 is folded around the substrate layer 115 so that the portions of the slot 114 which, during fundamental resonance mode, are associated with a significant electric or magnetic field are located on the obverse face, while the portions of the slot 114 which, during fundamental resonance mode, are associated with negligible or substantially zero electric or magnetic field are located mainly on the reverse face.

The close proximity of the end regions 134, 136 and their respective slot portions on the reverse face of the antenna 110 does not cause mutual interference because the slot portions are associated with little or no magnetic current/electric field. The maximum magnetic current points along the slot 14 (and correspondingly the locations of the maximum electric field across the slot 14) occur substantially at the mid-point of the slot portions 124, 126 on the obverse face of the antenna 110. Moreover, any significant magnetic current in, or electric field across, the slot 14 is associated with regions of the slot portions 124, 126 that are located on the obverse face of the antenna 110. Accordingly, the behaviour of the near-field electromagnetic fields in the antenna 110 are not adversely affected when compared to a corresponding unfolded antenna.

As a result, the overall width Wb of the antenna 110 is significantly less than the width W of a corresponding unfolded antenna (and so the area of antenna 110 is correspondingly reduced) without adversely affecting the performance of the antenna 110 in terms of bandwidth or radiation efficiency in comparison with the corresponding unfolded antenna.

An alternative embodiment of the invention is now described by way of example and with reference to FIGS. 5*a* to 5*f* which illustrate a folded planar lamina antenna, in the preferred form of a planar monopole antenna. Referring first to FIGS. 4*a* to 4*f*, there is shown an unfolded planar antenna 210, or lamina antenna, comprising a layer 212 of conductive material which defines a radiator lamina 216. The radiator lamina 216 serves as the resonant structure of the antenna 210 during use. A feed line 221 is provided for supplying electromagnetic signals to, and/or receiving electromagnetic signals from, the lamina 216. In preferred embodiments, the feed line 221 is arranged to supply signals to/receive signals from the lamina 216 via a feed portion or point 220 which is located at an edge 217 of the lamina 216, preferably substantially at the mid-point of the edge 217. The feed line 221 may take any suitable form, for example a microstrip line or coplanar waveguide. The lamina 216 may be generally rectangular in shape and may typically have an aspect ratio of between 1:1 to 1:2, the feed point 220 typically being located on one of the longer edges (when the aspect ratio is other than 1:1). The lamina 216 is typically carried by a substrate layer 215 of, for example, dielectric material, e.g. ceramic. Typically, the substrate layer 215 is larger than the lamina 216 in order to provide a strip of substrate material around substantially the entire periphery of the lamina 216.

Figures 4A, 4B, 4C, 4D, 4E, 4F:
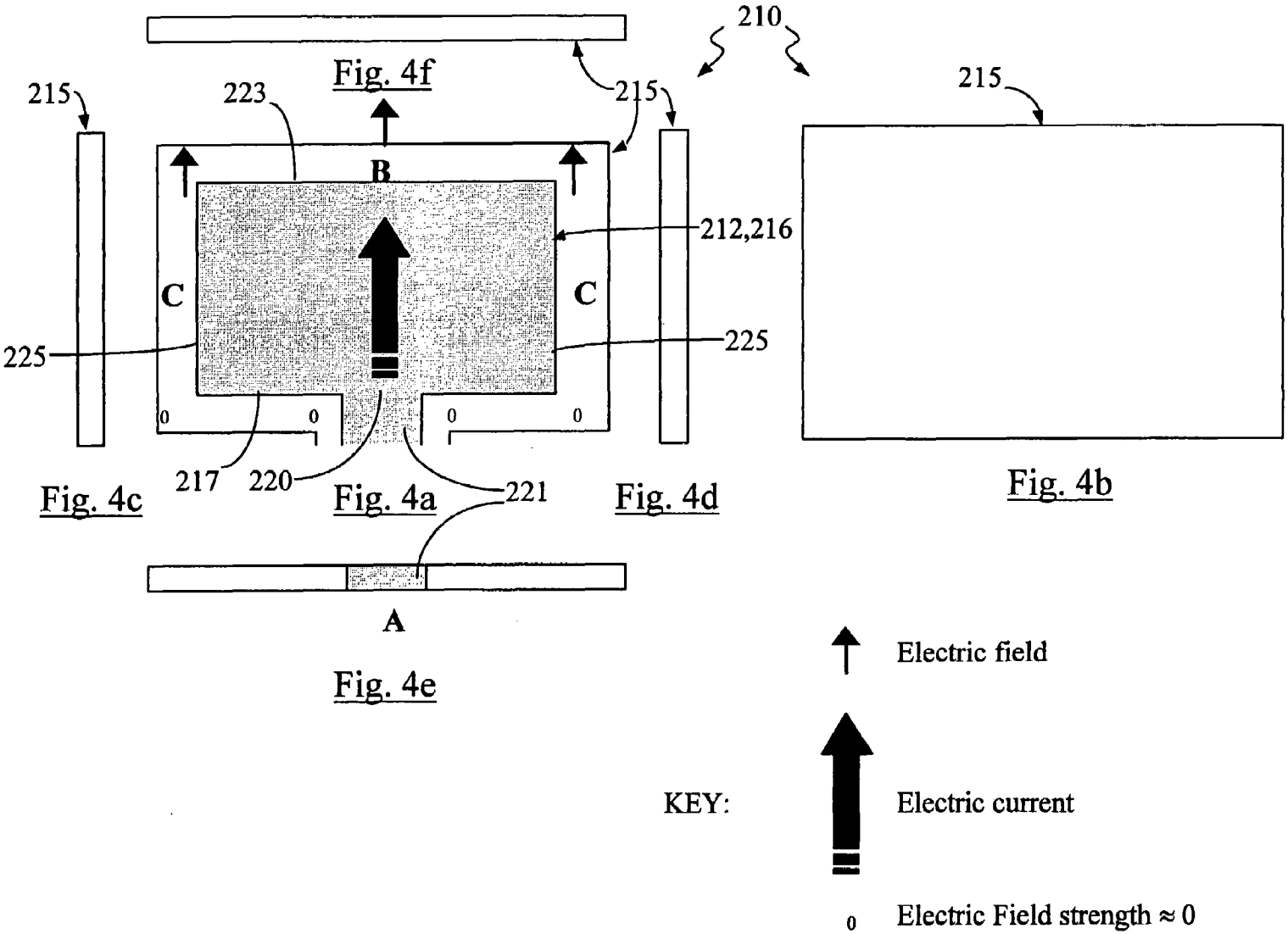
FIG. 4*a* is a plan view of the obverse face of a rectangular lamina antenna.
FIG. 4*b* is a plan view of the reverse face of the antenna of FIG. 4*a;*
FIGS. 4*c* to 4*f* each present a respective side view of the antenna of FIG. 4*a;*

FIG. 4*a* shows the obverse face of the antenna 210, FIG. 4*b* shows the reverse face and FIGS. 4*c* to 4*f* each show a respective side face. It will be seen that the lamina 216 is carried wholly by the obverse face, that the reverse face of the antenna 210 comprises substrate carrying no conductive material and that the only side face to carry conductive material is the side face associated with the feed line 220.

The antenna 210 is generally similar to the antennas 10, 110 with the peripheral ground plane 18, 118 (and therefore the slot 14, 114) removed. In one or more resonant modes of operation, for example when fed externally with an electromagnetic signal in an operational frequency band via the feed line 221, the antenna 210 behaves as a quarter-wavelength planar monopole antenna. In such modes of operation, the main resonant electric current path originates at, or adjacent, the feed point 220 at the centre of the edge 217 of the lamina 216 (shown as point A), and extends to a region or point between the centre of the opposite edge 223 of the lamina 216 (point B) and the centre of the other edges 225 (i.e. the edges running between edges 217, 223) of the lamina 216 (points C). The actual electric current path depends on the excitation frequency, and the lowest well-matched frequency is determined by the length L between Point A and Point B. Thus the bandwidth of the planar monopole is relatively large, the practical upper limit being approximately set by the half-width W/2 (where W is the length of edges 217, 223 and, in the present example, W/2 is the distance from the feed point 220 to the corner at the intersection of edges 217, 225). Correspondingly, the electric field is near, or substantially, zero at or adjacent the feed point 220 and increases to a maximum at the respective Points B and C, depending on excitation frequency.

Since the electric field is relatively low along the edges 225 of the lamina 216 between the edge 217 and point C, the antenna 210 may be folded in a manner similar to that described in relation to FIGS. 1 to 3 in order to reduce the size of the antenna 210 ( in a direction parallel with edges 217, 223). It is found that folding the antenna 210 in this way does not have a significant effect on the bandwidth in comparison with a corresponding unfolded planar monopole antenna.

Figures 5A, 5B, 5C, 5D, 5E, 5F:
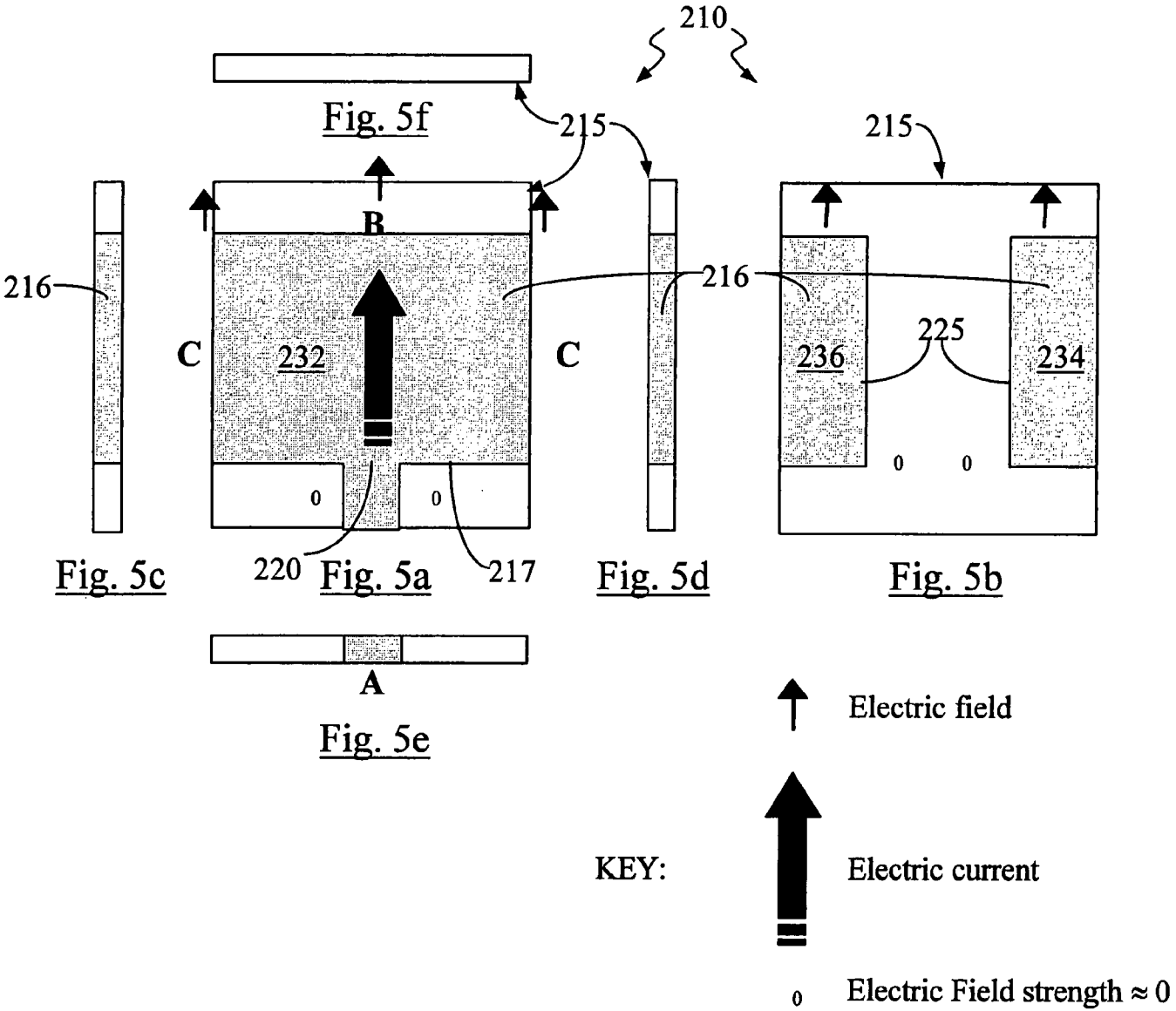

FIGS. 5*a* to 5*f* show the antenna 210 folded to produce a folded lamina antenna 210. FIG. 5*a* shows the obverse face of the antenna 210, FIG. 5*b* shows the reverse face and FIGS. 5*c* to 5*f* each show a respective side face. It will be seen that a central region 232 (including the feed point 220) of the lamina 216 is provided on the obverse face of the antenna 210 and that first and second end regions 234, 236 of the lamina 216 are located on the reverse face of the antenna 210, where the central region 232 is located between the end regions 234, 236 when the lamina 216 is unfolded. In the preferred embodiment where the feed point 220 is located at the edge 217, the end regions 234, 236 include the edges 225. Because the lamina 216 is folded or wrapped around the substrate layer 218, the sides of the antenna 210 (FIGS. 5*c* and 5*d*) each carry a portion of the lamina 216.

The antennas 110, 210 are generally planar in form although they may more accurately be described as folded planar antennas.

The invention is not limited to use with antennas in which the conductive layer is carried by a substrate. For example, a conductive layer 12, 112 of the type shown in FIGS. 1 and 3 may be used as antenna and may be folded in the manner described herein without the presence of a supporting substrate layer.

Figure 6:
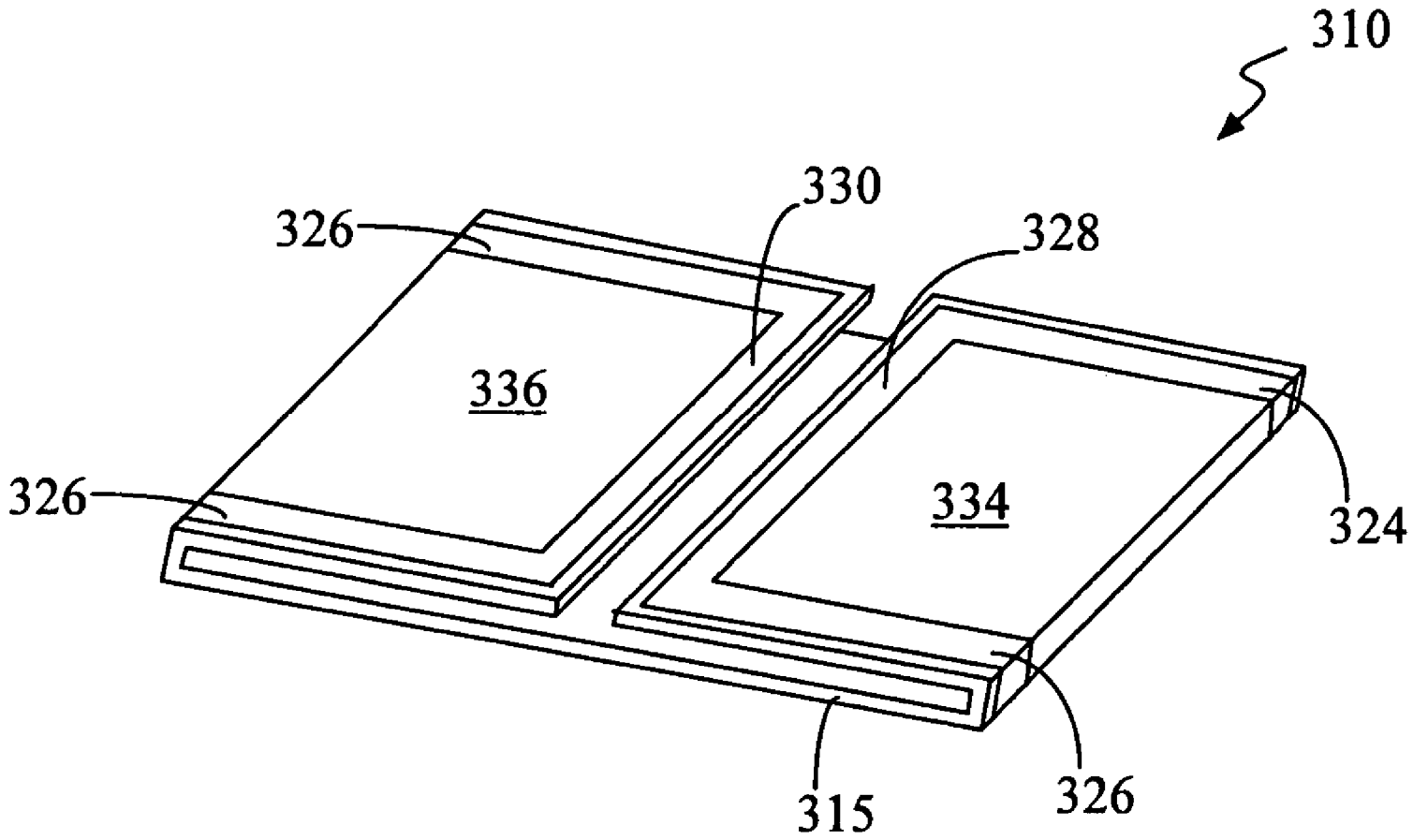
* and FIG. 6 is a perspective view from the reverse face of an alternative embodiment of an antenna according to the invention.

In an alternative embodiment (FIG. 6), one or more end regions 334, 336 (including some of slot portions 324, 326 and slot portions 328, 330) of the conductive layer and the respective portions of the substrate layer 315 on which they lie are folded to lie in a plane that is substantially parallel with the primary plane in which the central region of the conductive layer lies. Hence, not only is the conductive layer folded on itself, but the substrate layer 315 is also folded on itself The substrate 315 may be folded so as to define a gap, or cavity, between the folded substrate portion(s) and the unfolded substrate portion. In FIG. 6, the antenna 310 is shown with its reverse face facing upwardly. The obverse face (not visible in FIG. 6) may be generally similar to the obverse face of the antenna 110 shown in FIG. 2*a*.

The invention is not limited to use with rectangular loop slots. The loop slot may take a variety of alternative shapes comprising straight and/or curved sides. Similarly, the invention is not limited to use with planar antenna that are generally rectangular in shape.

The invention is not limited to the embodiments described herein which may be modified or varied without departing from the scope of the invention.

The invention claimed is:

1. An antenna comprising a lamina of conductive material, a slot loop being formed in the lamina, the antenna being operable in at least one resonant operational modes in which at least one portion of the slot loop is associated with an relatively high electromagnetic field and in which at least one other portion of the slot loop is associated with a relatively low or substantially zero electromagnetic field, wherein the lamina is folded on itself so that said at least one portion of the slot loop lies in a first plane and said at least one other portion of the slot loop lies in a second plane, the second plane being substantially parallel with the first plane, and wherein said antenna comprises a first and a second end region, and a central region located between the first and second end regions, each region comprising a respective portion of the lamina, and wherein said central region is located in said first plane and at least part of one or both of said end regions are located in said second plane, and wherein the central region includes at least two spaced apart portions of said slot loop and each end region includes a respective portion of said slot loop.

2. An antenna as claimed in claim 1, wherein a feed point, by which electromagnetic signals may be supplied to and received from the antenna, is provided at an edge of the lamina.

3. An antenna as claimed in claim 2, wherein said feed point is included in said central region.

4. An antenna as claimed in claim 2, wherein said feed point is located substantially at the mid-point of said edge.

5. An antenna as claimed in claim 2, wherein one or both end regions is folded about a respective notional fold line, which fold lines run substantially perpendicular with the edge comprising the feed point.

6. An antenna as claimed in claim 1, wherein the end regions are each folded about a respective notional fold line, which fold lines run substantially parallel with one another.

7. An antenna as claimed in claim 1, wherein said lamina is provided on a substrate layer, the lamina being folded around said substrate layer so that said at least one portion of the antenna is located on an obverse face of the substrate layer and said at least one other portion of the antenna is located on a reverse face of the substrate layer.

8. An antenna as claimed in claim 1, wherein the lamina is generally rectangular.

9. An antenna as claimed in claim 1, wherein the slot loop is generally rectangular and is defined by first and second generally parallel slot portions and third and fourth generally parallel slot portions, the first and second slot portions being generally perpendicular with the third and fourth slot portions, and wherein the conductive layer is folded so that said third and fourth slot portions lie in said second plane.

10. An antenna as claimed in claim 1, wherein said conductive layer is provided on a substrate layer, the conductive layer being folded around said substrate layer so that said at least one portion of said slot loop is located on an obverse face of the substrate layer and said at least one other portion of said slot loop is located on a reverse face of the substrate layer.

11. An antenna as claimed in claim 1, wherein said antenna is operable in a full wavelength, or fundamental, resonant operational mode in which the electrical length of said loop slot is substantially equal to the wavelength of signals at the operational frequency of the antenna.

12. An antenna comprising a lamina of conductive material, and a layer of conductive material which provides said lamina and which is shaped to define a slot loop around said lamina the antenna being operable in at least one resonant operational mode in which at least one portion of the antenna is associated with an relatively high electromagnetic field and in which at least one other portion of the antenna is associated with a relatively low or substantially zero electromagnetic field, wherein the lamina is folded on itself so that said at least one portion of the antenna lies in a first plane and said at least one other portion of the antenna lies in a second plane, the second plane being substantially parallel with the first plane, and wherein said at least one other portion is folded with respect to said at least one portion such that, in said at least one resonant operational mode, there is substantially no destructive electromagnetic interference between the respective electromagnetic near-fields generated by said antenna portions, the antenna being operable in one or more resonant operational modes in which at least one portion of said slot loop is associated with a relatively high electromagnetic field and in which at least one other portion of said slot loop is associated with a relatively low or substantially no electromagnetic field, wherein the conductive layer is folded on itself so that said at least one portion of said slot loop lies in said first plane and said at least one other portion of said slot loop lies in said second plane.

13. An antenna as claimed in claim 12, wherein said antenna comprises a first and a second end region, and a central region located between the first and second end regions, each region comprising a respective portion of the lamina, and wherein said central region is located in said first plane and at least part of one or both of said end regions are located in said second plane.

14. An antenna as claimed in claim 13, wherein the end regions are each folded about a respective notional fold line, which fold lines run substantially parallel with one another.

15. An antenna as claimed in claim 12, wherein a feed point, by which electromagnetic signals may be supplied to and received from the antenna, is provided at an edge of the lamina.

16. An antenna as claimed in claim 15, wherein said antenna comprises a first and a second end region, and a central region located between the first and second end regions, each region comprising a respective portion of the lamina, and wherein said central region is located in said first plane and at least part of one or both of said end regions are located in said second plane, and wherein said feed point is included in said central region.

17. An antenna as claimed in claim 15, wherein said feed point is located substantially at the mid-point of said edge.

18. An antenna as claimed in claim 15, wherein one or both end regions is folded about a respective notional fold line, which fold lines run substantially perpendicular with the edge comprising the feed point.

19. An antenna as claimed in claim 12, wherein said lamina is provided on a substrate layer, the lamina being folded around said substrate layer so that said at least one portion of the antenna is located on an obverse face of the substrate layer and said at least one other portion of the antenna is located on a reverse face of the substrate layer.

20. An antenna as claimed in claim 12, wherein the lamina is generally rectangular.

* * * * *